United States Patent [19]

Klüttermann et al.

[11] Patent Number: 4,965,912

[45] Date of Patent: Oct. 30, 1990

[54] METHOD AND APPARATUS FOR SEVERING THE SLIVER IN SLIVER COILERS

[75] Inventors: Jürgen Klüttermann; Helmut P. Mösges, both of Mönchengladbach, Fed. Rep. of Germany

[73] Assignee: Trützschler GmbH & Co. KG, Mönchengladbach, Fed. Rep. of Germany

[21] Appl. No.: 319,579

[22] Filed: Mar. 6, 1989

[30] Foreign Application Priority Data

Mar. 5, 1988 [DE] Fed. Rep. of Germany ..... 3807239

[51] Int. Cl.[5] ..... D01G 27/00

[52] U.S. Cl. ..... 19/159 R; 19/159 A

[58] Field of Search ..... 19/0.3, 0.35, 0.41, 19/0.43, 150, 157, 159 A, 159 R

[56] References Cited

U.S. PATENT DOCUMENTS

| | | | |
|---|---|---|---|
| 1,047,438 | 12/1912 | Owen | 19/159 R |
| 3,246,371 | 4/1966 | Tooka et al. | 19/159 A |
| 3,308,520 | 3/1967 | Gagnon | 19/157 |
| 3,334,385 | 8/1967 | West et al. | 19/159 R |
| 3,354,513 | 11/1967 | Fornes | 19/159 A |
| 4,179,773 | 12/1979 | Savageau | 19/159 A |

FOREIGN PATENT DOCUMENTS

| | | |
|---|---|---|
| 8000044 | 7/1980 | European Pat. Off. . |
| 1091010 | 10/1960 | Fed. Rep. of Germany . |
| 1290460 | 10/1969 | Fed. Rep. of Germany . |
| 1510428 | 3/1971 | Fed. Rep. of Germany . |
| 2354634 | 5/1974 | Fed. Rep. of Germany . |
| 3324461 | 10/1984 | Fed. Rep. of Germany . |
| 3409825 | 10/1985 | Fed. Rep. of Germany . |
| 3633428 | 4/1988 | Fed. Rep. of Germany . |
| 1547972 | 10/1968 | France . |
| 2186014 | 1/1974 | France . |
| 375255 | 3/1964 | Switzerland . |
| 436051 | 11/1967 | Switzerland . |
| 205877 | 10/1923 | United Kingdom . |
| 418291 | 7/1933 | United Kingdom . |
| 883306 | 11/1961 | United Kingdom . |
| 1244317 | 8/1971 | United Kingdom . |
| 2145122 | 3/1985 | United Kingdom . |

*Primary Examiner*—Werner H. Schroeder
*Assistant Examiner*—Michael A. Neas
*Attorney, Agent, or Firm*—Spencer & Frank

[57] ABSTRACT

A sliver coiler for depositing a running sliver into a coiler can includes a driven roller pair including two cooperating rollers arranged for advancing the sliver passing therebetween in a feed direction; and a sliver trumpet supported upstream of the roller pair as viewed in the feed direction and having a passage through which the sliver runs. The sliver trumpet has a first position in which the sliver exit of the passage immediately adjoins and faces the roller pair of a second position in which the sliver exit is at a greater distance from the roller pair than in the first position. The coiler further has a coiler head arranged downstream of the roller pair and arranged for receiving the sliver and forwarding the sliver into a coiler can; a drive for displacing the sliver trumpet between the first and second positions; and a clamping arrangement for grasping the sliver at a location between the sliver entrance of the sliver trumpet and the roller pair. The clamping arrangement has a clamping position in which the sliver is grasped thereby and an open position in which the sliver is released.

20 Claims, 7 Drawing Sheets

1
2
3
4
4a
5
5a
6
7
8
9
9a
9d
9e
9f
10
10a
11
13
14
15
A
B
C
T
R
CU

FIG.5
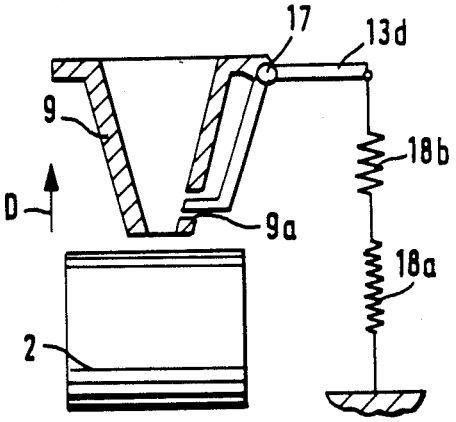
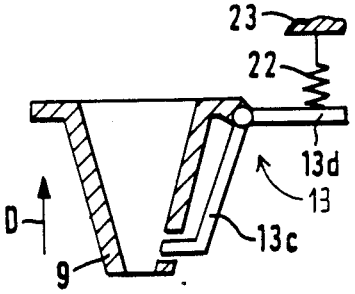
FIG.7
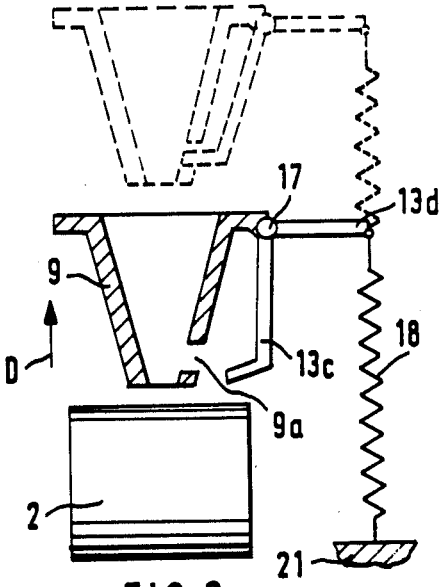
FIG.6

METHOD AND APPARATUS FOR SEVERING THE SLIVER IN SLIVER COILERS

CROSS REFERENCE TO RELATED APPLICATION

This application claims the priority of Federal Republic of Germany Application No. P 38 07 239.4 filed Mar. 5th, 1988, which is incorporated herein by reference.

BACKGROUND OF THE INVENTION

The invention relates to a method and an apparatus for severing a running sliver during the deposition of the sliver into a can. Such a severance of the sliver is effected when the coiler can is full and is replaced by an empty can. As an automatic can replacement takes place (or shortly therebefore), the distance between a sliver trumpet situated above the coiler head of the sliver depositing mechanism and the downstream-arranged calender rollers is increased, whereupon rupture of the sliver is effected In a known process the distance between the sliver trumpet situated at the upper part of the coiler head and the downstream-arranged calender rollers is increased for a short time period such that the sliver breaks between the trumpet and the calender rollers. It is a disadvantage of such a method that the distance has to be different dependent upon the length of the fiber staple In case of fiber staples of large lengths such as long-staple cotton, a large distance has to be selected since the relative cohesion of the fiber mass is large. In case only a short distance is selected when long-staple fibers are used, disadvantageously no breakage of the sliver may occur.

SUMMARY OF THE INVENTION

It is an object of the invention to provide an improved method and apparatus of the above-outlined type from which the discussed disadvantages are eliminated and which, in particular, ensures a secure severance and rethreading of the sliver during coiler can replacement.

This object and others to become apparent as the specification progresses, are accomplished by the invention, according to which, briefly stated, the sliver is, during or subsequent to the increase of the distance between the sliver trumpet and the calender rollers securely clamped, ensuring a rupture of the sliver between the sliver trumpet and the calender rollers as the latter continue to advance the sliver, whereby a rupturing tension is generated.

It is an advantage of the invention that the severance of the sliver can be ensured in a simple and secure manner irrespective of the staple length of the fiber material.

Advantageously, subsequent to severing the sliver, the distance between the trumpet and the calender rollers is again decreased such that the open end of the severed sliver is positioned on the calender rollers and introduced into the gap therebetween. As soon as the rotating calender rollers have grasped the sliver, the calender rollers pull the sliver from the trumpet and the sliver deposition continues. The sliver is, before or during the decrease of the distance, released from the clamping arrangement. This arrangement thus makes possible an automatic resumption of the sliver deposition subsequent to the severance thereof.

The apparatus for performing the process has a sliver trumpet whose position may be changed in a direction parallel to the direction of sliver run and with the sliver trumpet a clamping device is associated for holding firmly the sliver.

The apparatus has the following additional advantageous features:

the clamping device is situated above the calender rollers, outside the sliver trumpet;

the clamping device is situated within the sliver trumpet;

the clamping device has at least one movably supported clamping element which cooperates with a counterface;

the counterface is an inner wall face of the sliver trumpet;

the sliver trumpet is pivotally supported;

the clamping element is spring biased;

the clamping element is spring biased only after the sliver trumpet has changed its position;

the clamping element becomes spring biased during the change of position of the sliver trumpet;

the position of the clamping device may be changed, that is, for example, it may be linearly movable or pivotal;

the sliver trumpet and the clamping device are together supported such that they can change position as a unit;

the clamping device is immovably supported;

the clamping element of the clamping device may be latched or unlatched for effecting clamping or releasing, respectively.

The sensor for determining the fill condition of the cans, the drive for the sliver feed (such as the coiler head drive), the drive motor for the can conveying device (such as a rotary platform) and the driving device for the sliver severing apparatus are electrically connected to one another for synchronizing the can replacing, sliver severing and sliver rethreading operations.

BRIEF DESCRIPTION OF THE DRAWING

FIGS. 5–13 are schematic sectional side elevational views of nine further preferred embodiments of the invention.

DESCRIPTION OF THE PREFERRED EMBODIMENTS

Figure 1:
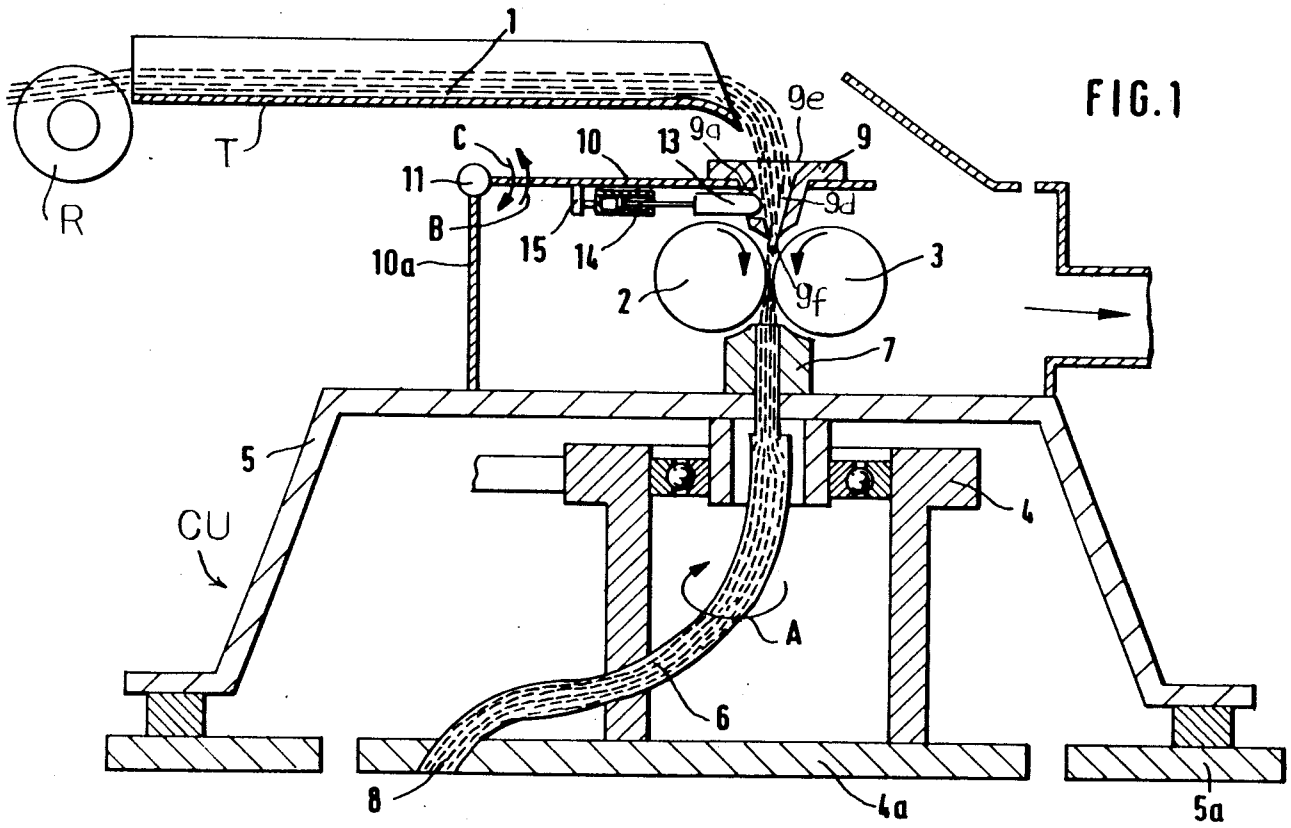
FIG. 1 is a schematic sectional side elevational view of a sliver coiler incorporating a preferred embodiment of the invention.

Turning to FIG. 1, there is illustrated therein a sliver coiler unit CU which may be connected to the output of a conventional carding machine such as, for example, an EXACTACARD DK 740 manufactured by Trützschler GmbH & Co. KG, Mönchengladbach, Federal Republic of Germany. The card may process short-staple or long-staple fiber material.

Figure 16:
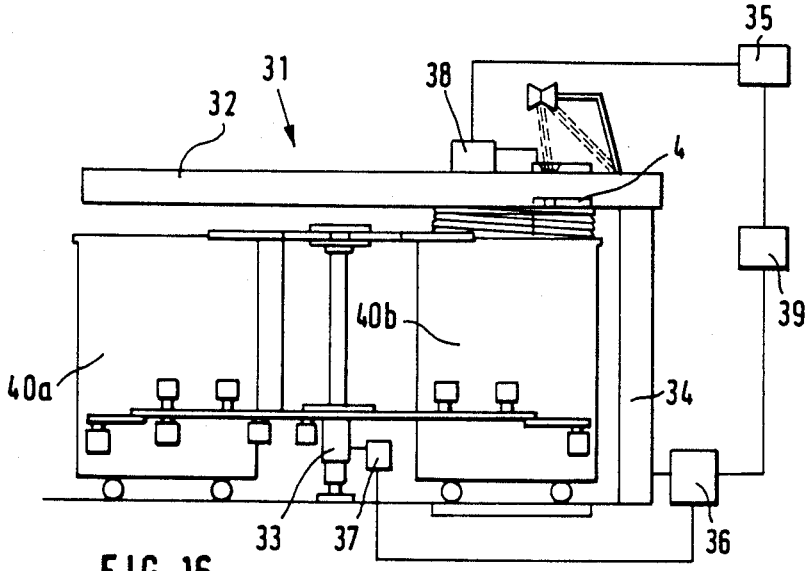
FIG. 16 is a block diagram illustrating cooperation of components of a coiler, incorporating the invention.

The sliver 1 which is the output product of the card, is delivered over a supporting roller R and a support tray T to the coiler unit CU which has a pair of stationarily supported cooperating rotary calender rollers 2 and 3 for advancing the sliver. The coiler unit CU deposits the sliver into sequentially aligned coiler cans held, for example, in a carousel-type can mover as schematically shown in FIG. 16. The roller pair formed of the calender rollers 2 and 3 deliver the sliver 1 at a high speed of up to 1,000 m/min (for example, in excess of 300 m/min) and a rotating coiler head 4 deposits the sliver in a coiled state into a rotating coiler can arranged eccentrically below the coiler head 4. The coiler head 4 is suspended in a stationary carrier 5 by means of roller bearings for rotation about a vertical axis. The carrier 5 may be stationarily supported by mounts attaching it to a machine frame.

In the coiler head 4 there is provided a rotary sliver guiding conduit 6, upstream of which a nipple guide 7 is mounted on a top face of the carrier 5 and aligned with the rotary axis of the coiler head 4. The conduit 6 extends obliquely downwardly, exits through the side of the coiler head 4 and terminates at an exit opening 8 provided in a head plate 4*a* attached to the coiler head 4. The sliver guiding conduit 6 has a curved course. As the coiler head 4 rotates, the sliver guiding tube revolves as indicated at A. Upstream of the calender rollers 2 and 3 (as viewed in the direction of sliver feed) a sliver trumpet 9 is mounted in a closure plate 10 which is secured to a vertical cover plate 10*a* at 11 for pivotal motion about a vertical plane as indicated by the arrows B and C. The trumpet 9 has a sliver passage 9*d* provided with a sliver inlet 9*e* and a sliver exit 9*f*. When the coiler can is full, the sliver deposited therein projects upwardly beyond the upper edge of the coiler can (as may be observed in FIG. 16) and the deposited fiber mass, by virtue of the inherent elasticity of the sliver 1 and due to a biasing force of an upwardly urged can bottom, is pressed against the underface of the head plate 4*a* and, radially therebeyond, against the stationary frame plate 5*a*.

The sliver trumpet 9 is provided, in its lateral wall, with a throughgoing aperture 9*a* through which extends a plunger-like clamping element 13. At its outer end the clamping element 13 is coupled to a power cylinder 14 which, in turn, is supported on an extension 15 affixed to the pivotal closure plate 10 of the cover plate 10*a*. The clamping element 13 cooperates with the oppositely located zone of the inner wall face of the sliver trumpet 9. Since both the sliver trumpet 9 and the clamping element 13 are mounted on the pivotal closure plate 10, the sliver trumpet 9 and the clamping element 13 are displaceable as a unit.

Figure 2A:
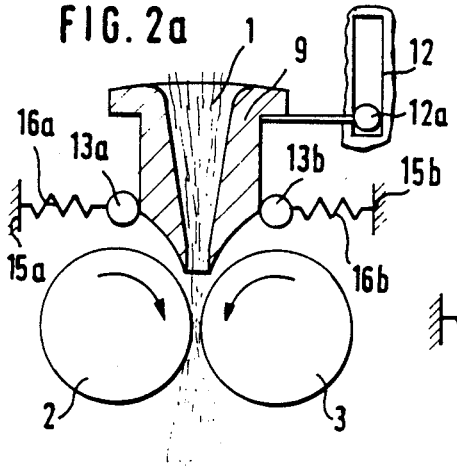
FIGS. 2*a*–2*d* are schematic sectional elevational views of another preferred embodiment of the invention, illustrating different operational positions.
Figure 2B:
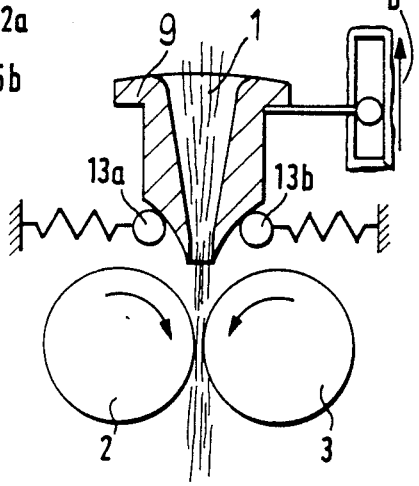
Figure 2C:
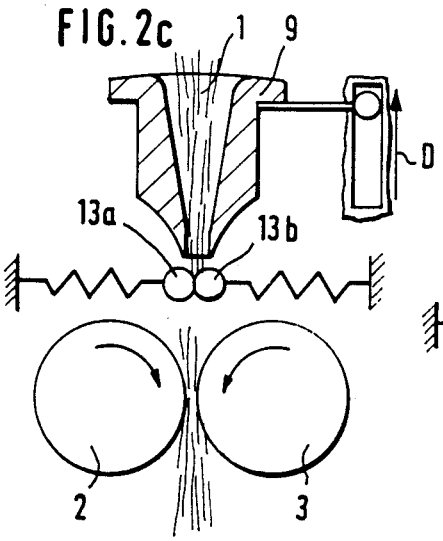
Figure 2D:
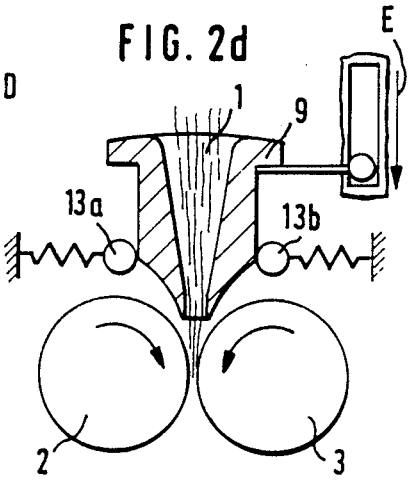

Turning now to the embodiment illustrated in FIGS. 2*a*–2*d*, there is illustrated therein a linearly displaceable sliver trumpet 9 supported in a slide bearing 12. There is further provided a two-part clamping element 13*a*, 13*b* mounted on opposite, stationary supports 15*a*, 15*b*, respectively. In FIG. 2*a* the sliver trumpet 9 is in its lowermost, normal operating position (that is, closest to the calender rollers 2, 3) and the two clamping elements engage the outer circumferential surface of the trumpet 9, biased thereagainst by respective compression springs 16*a*, 16*b*. To effect a sliver breaking operating to provide a transition from a full can to an empty one, the sliver trumpet is displaced as shown in FIGS. 2*b* and 2*c*. In FIG. 2*b* the sliver trumpet 9 has been moved away slightly from the calender rollers 2, 3 in the direction indicated by arrow D to a point where the clamping elements 13*a*, 13*b*, urged by the respective springs 16*a*, 16*b* ride downwardly on the concave slope of the sliver trumpet 9. Thus, while the clamping elements 13*a* and 13*b* have moved towards one another they are still separated from one another by the sliver trumpet 9. In FIG. 2*c*, there is shown a position of the sliver trumpet 9 in which it is farthest away from the calender rollers 2 and 3 and the clamping elements 13*a* and 13*b* have left the concave sloping part of the sliver trumpet 9 and are in a mutually contacting position, urged towards one another by the respective springs 16*a* and 16*b*. In this position of the clamping elements 13*a*, 13*b* they firmly clamp the sliver 1. By virtue of the pulling force of the continuously rotating calender rollers 2 and 3 the sliver 1 breaks. Thereafter, as illustrated in FIG. 2*d*, the sliver trumpet 9 is moved back into its original position in the direction of the arrow E; the clamping elements 13*a*, 13*b* are pushed apart by the camming surfaces of the sliver trumpet 9, the calender rollers 2 and 3 grasp the new downstream end of the sliver 1 which projects beyond the downstream opening of the sliver trumpet 9. In this manner, the calender rollers 2 and 3 pull the sliver out of the sliver trumpet 9 whereby the sliver feed into a new, empty can is resumed.

Figure 3A:
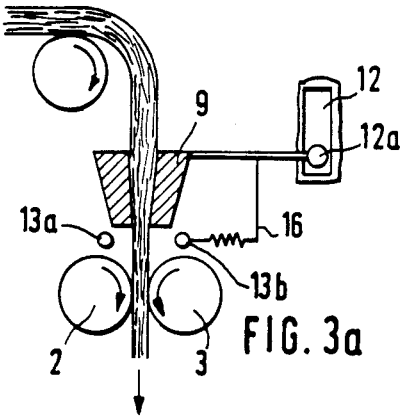
FIGS. 3*a*–3*c* are schematic sectional side elevational views of a further preferred embodiment of the invention illustrating different operational positions.
Figure 3B:
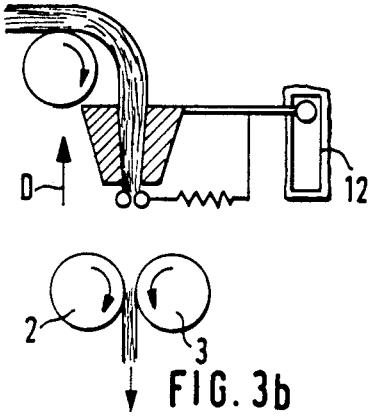
Figure 3C:
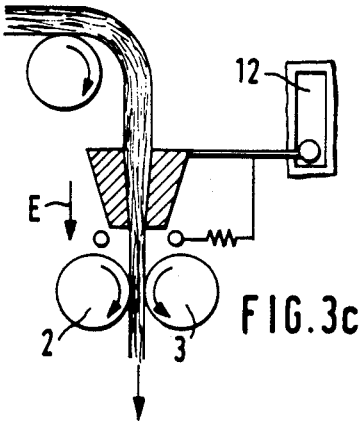

Turning now to the embodiment shown in FIGS. 3*a*–3*c*, the construction shown therein is similar to that of FIGS. 2*a*–2*d* except that the sliver trumpet 9 and the clamping elements 3*a* and 3*b* may be displaced together in the direction of the arrows D and E. The sliver trumpet 9 and the clamping elements 13*a* and 13*b* are firmly secured to one another by means of a holding element 16. The clamping elements 13*a* and 13*b* are situated at all times at a constant distance from the sliver trumpet 9, downstream thereof as viewed in the direction of advance of the sliver 1. The clamping elements 13*a*, 13*b* may be mounted at the end of a scissors-like, solenoid-actuated linkage assembly (not shown) for simultaneous movement toward or away from one another.

Figure 4A:
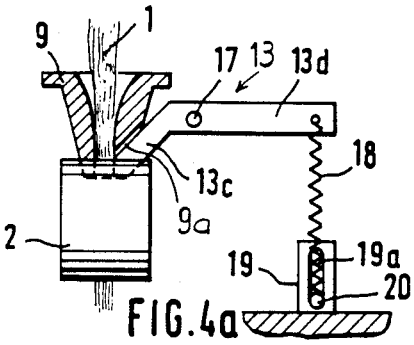
FIGS. 4*a*–4*c* are schematic sectional side elevational views of still another preferred embodiment of the invention illustrating different operational positions.
Figure 4B:
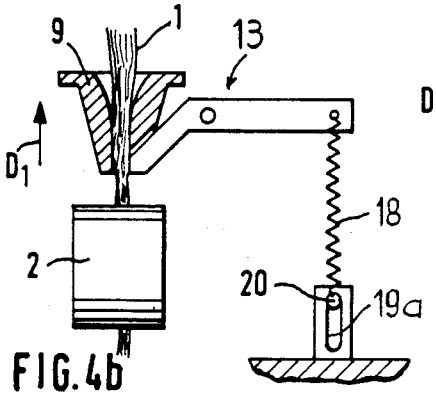
Figure 4C:
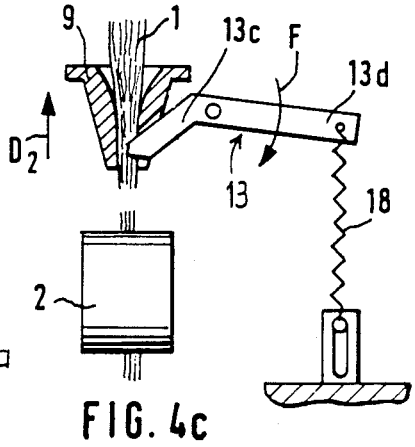

Turning now to the embodiment illustrated in FIGS. 4*a*–4*c*, the clamping element 13 is a two-arm lever pivotally secured at 17 and having arms 13*c* and 13*d*. The arm 13*c* projects through an opening 9*a* in the wall of the sliver trumpet 9. To the free end of the arm 13*d* there is secured one end of a tension spring 18 whose other end is movably supported in a post 19. For this purpose, the post 19 has a slot 19*a* in which there is slidably arranged a pin 20 attached to an end of the spring 18. FIG. 4*a* illustrates the apparatus in its working position when the sliver 1 is pulled through the sliver trumpet 9 by the calender rollers 2 and 3 (only the calender roller 2 is visible in FIGS. 4*a*, 4*b* and 4*c*). According to FIG. 4*b*, the sliver trumpet 9 has moved away from the calender rollers in the direction of the arrow $D_1$ into a first stage. A motion into the first stage is simultaneously performed by the clamping member 13; the pin 20 is pulled to the upper boundary of the slot 19*a* and thus the spring 18 has not yet been tensioned.

As it is further seen from a comparison of FIGS. 4a and 4b, the angular position of the clamping member 13 has also not yet changed. As shown in FIG. 4c, the sliver trumpet 9 is further raised in the direction of the arrow $D_2$ into a second stage further away from the calender rollers 2, 3. During the motion from the first stage to the second stage of the sliver trumpet 9 and the clamping member 13, the spring 18 is tensioned, whereby the clamping member 13 is rotated in the direction of the arrow F such that the clamping terminus of the arm 13c penetrates into the bore 9a of the sliver trumpet 9 and firmly clamps the sliver 1 against the opposite inner wall of the trumpet born. As in the previous embodiments, the calender rollers 2, 3 continue their rotation and thus the feed of the sliver whereupon the sliver breaks downstream of the clamping location. The subsequent lowering of the sliver trumpet 9, together with the clamping member 13 into the original position shown in FIG. 4a causes the free end of the sliver 1 projecting beyond the downstream outlet of the sliver trumpet 9 to be grasped by the cooperating calender rollers 2 and 3 whereupon the normal feeding of the sliver 1 is resumed.

Turning now to the embodiment shown in FIG. 5, the structure illustrated therein is similar to that of the embodiment of FIGS. 4a–4c except that two serially connected tension springs 18a and 18b are provided which have different spring characteristics, whereby a two-stage operation similar to the embodiment shown in FIGS. 4a–4c is achieved.

Turning to the embodiment shown in FIG. 6, the lever arm 13d of the clamping member 13 is connected to a tension spring 18 whose other end is attached to a stationary support 21. During normal operation, the clamping terminus of the lever arm 13c is situated externally of the trumpet 9. The spring 18 is tensioned as the sliver trumpet 9 moves with the clamping device 13 in the direction of the arrow D from the calender rollers 2, 3. As the distance between the sliver trumpet 9 and the calender rollers 2, 3 increases, the spring 18 is increasingly tensioned and the terminus of the lever arm 13c which terminus constitutes a clamping element penetrates into the opening 9a and clamps the sliver against the bore wall face of the trumpet 9.

Turning to the embodiment illustrated in FIG. 7, the construction shown therein is similar to the FIG. 6 embodiment, except that instead of a tension spring the lever arm 13d of the clamping element 13 is biased by a compression spring 22 which engages a stationary support 23.

Figure 8:
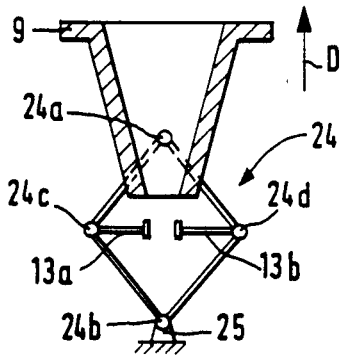

In the embodiment illustrated in FIG. 8 the clamping elements 13a and 13b are supported at opposite joints 24c and 24d of a parallelogram linkage. The two other opposite joints of the parallelogram linkage are articulated to the sliver trumpet 9 at 24a and to a stationary support 25 at 24b. When the sliver trumpet 9 is moved in the direction of the arrow D away from the calender rollers (not shown in FIG. 8), the clamping elements 13a and 13b are moved towards one another and clamp the running sliver (also not shown).

Figure 9:
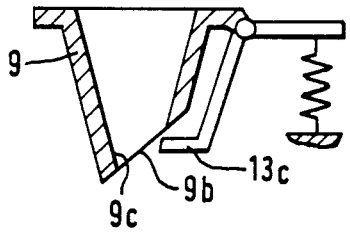

Referring now to the embodiment shown in FIG. 9, the outlet 9b of the sliver trumpet 9 is at an oblique angle relative to the trumpet inlet. By virtue of this arrangement, the clamping terminus of the lever arm 13c may penetrate into the trumpet bore through the sliver outlet opening to cooperate with the inner wall 9c.

Figure 10:
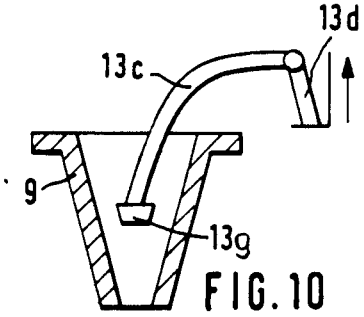

Turning to FIG. 10, in the embodiment illustrated therein the clamping terminus 13g is a plug-like component which partially or entirely fills the inner cross-sectional area of the sliver trumpet 9 and thus can clamp the sliver against the inner bore wall of the trumpet. During normal operation, the clamping element which is secured to the lever arm 13c may be substantially or entirely pivoted out of the sliver trumpet 9.

Figure 11:
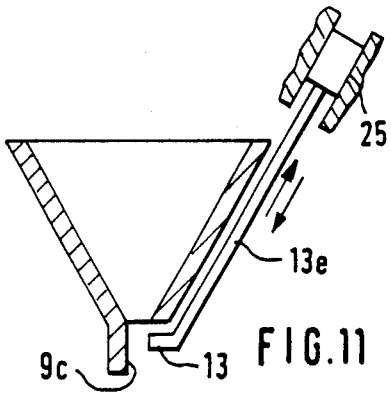

In the embodiment according to FIG. 11, the clamping element 13 is secured to the end of a holder bar 13e which has an opposite end slidably held in a slide bearing 25. The holding bar 13e and the bearing 25 are displaceable relative to the calender rollers in unison. The holding bar 13e is movable essentially parallel to the outer wall of the sliver trumpet 9. Upon downward sliding motion of the holder bar 13e effected by a power mechanism, the clamping terminus 13h engages the inner wall 9c of the sliver trumpet 9 thus clamping the sliver thereagainst.

Figure 12:
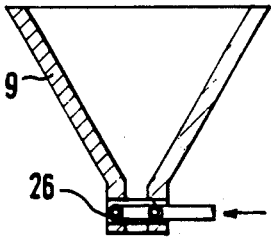

Turning now to the embodiment illustrated in FIG. 12, there is shown therein an elastic clamping ring 26 which is arranged in the lower zone of the sliver trumpet 9 and which is made of an elastic synthetic material or rubber. The diameter of the ring 26 may be enlarged or reduced, for example, mechanically by radially compressing the ring or pneumatically by admitting to or withdrawing air from the inner space of the ring. Such a contraction of the ring 26 will securely clamp the sliver which normally runs therethrough.

Figure 13:
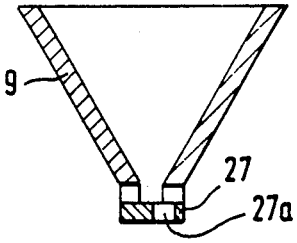

Turning to the embodiment illustrated in FIG. 13, underneath the outlet of the sliver trumpet 9 there is provided a slide element 27 which has a throughgoing bore 27a through which the sliver passes. By rotating or radially shifting the element 27, the outlet opening of the sliver trumpet 9 and the bore 27a will be misaligned thereby together firmly clamping the sliver 1.

Figure 14A:
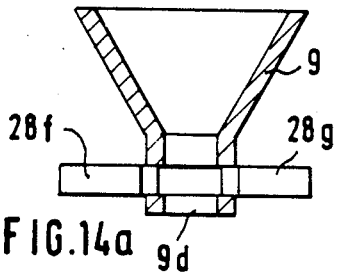
FIG. 14*a* is a schematic sectional elevational view of a further preferred embodiment of the invention.
Figure 14B:
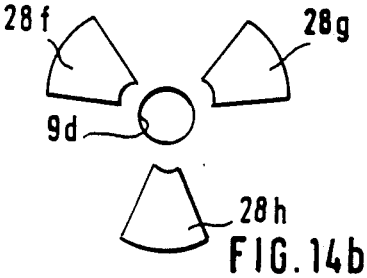
FIGS. 14*b* and 14*c* are schematic top plan views of some of the components shown in FIG. 14*a*, illustrated in two different operational positions.
Figure 14C:
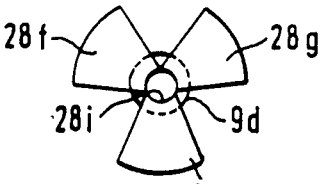

Turning now to the embodiment illustrated in FIGS. 14a–14c, there is shown a clamping element formed of a plurality of segments 28f, 28g and 28h which are arranged in a star-like configuration and which are movable radially towards or away from the inner bore 9d of the sliver trumpet 9 (not shown). The sectional elevational view of FIG. 14a and the top plan view of FIG. 14b shows the apparatus prior to clamping the sliver, whereas FIG. 14c shows in top plan view the device in the clamping state. The segments 28f, 28g and 28h form together—as shown in FIG. 14c—a ring 28i whose diameter is smaller than the diameter of the inner bore 9d.

Figure 15A:
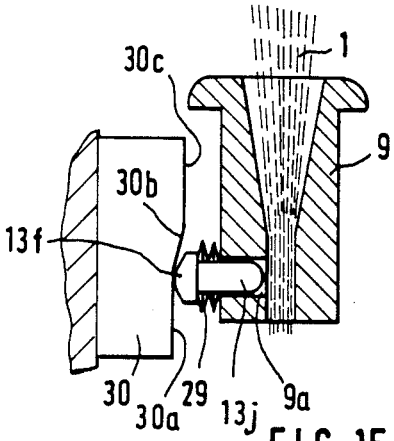
FIGS. 15*a* and 15*b* are schematic sectional side elevational views of still another preferred embodiment of the invention illustrated in two different operational positions.
Figure 15B:
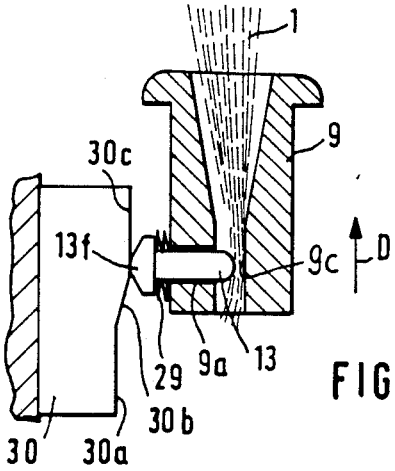

Turning to the embodiment in FIGS. 15a and 15b, the clamping element 13j is slidably supported in the lateral aperture 9a of the sliver trumpet 9 and is biased outwardly by spring discs 29. The end 13f of the clamping element 13j engages a stationary support 30 which has an inclined portion 30b between two parallel offset surfaces 30a and 30c. FIG. 15a illustrates the apparatus in a position when no sliver clamping takes place. Upon moving the sliver trumpet 9 according to FIG. 15b in the direction of arrow D, the terminus 13f rides up on the inclined face 30b and then engages the surface 30c whereby the clamping element is, against the force of the springs 29, pushed through the opening 9a into the inner space of the sliver trumpet 9 and thus firmly clamps the sliver 1 against the inner trumpet face 9c.

It is noted that in all the embodiments other than the construction shown in FIG. 1, the sliver trumpet 9 may be linearly guided towards and away from the calender rollers 2, 3 in linear slide bearings 12 as shown in FIGS. 2a–2d and 3a–3c.

FIG. 16 illustrates a coiler can replacing apparatus 31 which has a top plate 32, a rotary carousel 33 supporting coiler cans 40a, 40b and a lateral frame 34. A measuring member 35 which senses the extent of fill of the coiler can 40b while being charged with sliver by the coiler head 4, a drive 36 causing advance of the sliver (for example, the drive for rotating the coiler head 4), a drive motor 37 for the coiler can conveying device (for example, the drive for the carousel 33) and a driving device 38 effecting sliver severance (for example, the drive for moving the sliver trumpet 9 away from the calender rollers) are electrically connected to a control device 39 for effecting a sliver severance and a subsequent resumption of the sliver feed to a new coiler can in an automatic manner.

It will be understood that the above description of the present invention is susceptible to various modifications, changes and adaptations, and the same are intended to be comprehended within the meaning and range of equivalents of the appended claims.

What is claimed is:

1. A method of severing and rethreading a running sliver in a sliver coiler having a pair of rollers for advancing the sliver passing therebetween in a feed direction, a rotary coiler head situated downstream of the roller pair as viewed in the feed direction and receiving the sliver therefrom; and a sliver trumpet situated upstream of the roller pair and having a sliver entrance and a sliver exit; said sliver trumpet being arranged to guide the sliver to the roller pair as the sliver passes through the sliver trumpet; comprising the following steps;

(a) rotating the rollers of the roller pair, thereby pulling the sliver from the sliver trumpet and advancing the sliver to the coiler head;

(b) during the performance of step (a), moving said sliver trumpet away from said roller pair thereby increasing the distance between the sliver trumpet and the roller pair;

(c) during the performance of step (a), firmly clamping the running sliver at a location between said sliver entrance of said sliver trumpet and said roller pair thereby causing a rupturing tension to build up in said sliver, resulting in severance thereof, whereby advancement of the sliver is interrupted;

(d) moving the sliver trumpet, together with a free end of the sliver, toward said roller pair to a position in which said roller pair grasps the free end of the sliver; and (e) unclamping the sliver, thereby permitting the roller pair to resume advancement of the sliver.

2. A method as defined in claim 1, wherein step (c) comprises the step of clamping the sliver within the sliver trumpet, between said sliver entrance and said sliver exit.

3. A sliver coiler for depositing a running sliver into a coiler can, comprising:

(a) a driven roller pair including two cooperating rollers arranged for advancing the sliver passing therebetween in a feed direction;

(b) a sliver trumpet supported upstream of said roller pair as viewed in the feed direction and having a passage through which the sliver runs; said passage having a sliver entrance and a sliver exit; said sliver trumpet having a first position in which said sliver exit immediately adjoins and faces said roller pair and a second position in which said sliver exit is at a greater distance from said roller pair than in said first position;

(c) a coiler head arranged downstream of said roller pair and being arranged for receiving the sliver and forwarding the sliver into a coiler can;

(d) moving means for displacing said sliver trumpet between said first and second positions; and (e) clamping means for grasping the sliver at a location between said sliver entrance of said sliver trumpet and said roller pair; said clamping means having a clamping position in which the sliver is firmly grasped thereby and an open position in which the sliver is released from the clamping means.

4. A sliver coiler as defined in claim 3, further comprising means for guiding said sliver trumpet in a linear path between said first and second positions thereof.

5. A sliver coiler as defined in claim 3, further comprising means for guiding said sliver trumpet in an arcuate path between said first and second positions thereof.

6. A sliver coiler as defined in claim 3, further wherein said clamping means comprises two clamping elements supported at a location between said first and second positions of said sliver trumpet; spring means for urging said clamping elements toward one another; and camming faces provided on an outer surface of said sliver trumpet; said camming faces forcing the clamping elements apart against a force of said spring means into said open position when said sliver trumpet is in said first position and said camming faces being clear of said clamping elements in said second position of said sliver trumpet, allowing said clamping elements to assume said clamping position.

7. A sliver coiler as defined in claim 3, further wherein said clamping means comprises two clamping elements attached to said sliver trumpet for movement therewith in unison between said first and second positions; said clamping elements being movable towards and away from one another and being situated at all times downstream of said sliver exit at a predetermined distance thereform, as viewed in the feed direction.

8. A sliver coiler as defined in claim 3, wherein said sliver trumpet has a lateral opening communicating with said passage; further wherein said clamping means comprises a clamping element projecting, in said clamping position, through said lateral opening into said passage and cooperating with a wall face bounding said passage for clamping the sliver; said clamping means further comprising a drive connected to said clamping element for moving said clamping element into said clamping and open positions.

9. A sliver coiler as defined in claim 8, wherein said clamping element comprises a plunger slidably supported in said passage.

10. A sliver coiler as defined in claim 9, wherein said drive comprises a power cylinder unit arranged to travel with said sliver trumpet in unison; said power cylinder unit being connected to said plunger.

11. A sliver coiler as defined in claim 9, wherein said drive comprises a stationary cam face, and said plunger has a follower being urged into engagement with said cam face to travel thereon as the sliver trumpet, together with the plunger, moves between said first and second positions; said cam face having a course such that said plunger is in said clamping position when said sliver trumpet is in said second position and said plunger is in said open position when said sliver trumpet is in said first position.

12. A sliver coiler as defined in claim 8, wherein said clamping element comprises a two-arm lever pivotally secured at least indirectly to said sliver trumpet for moving therewith as a unit; said lever having a clamping terminus cooperating with said wall face; said drive comprising a spring having an end connected to said lever and another end connected to a support; said spring being stressed when said sliver trumpet assumes said second position, whereby said lever is moved into said clamping position.

13. A sliver coiler as defined in claim 12, wherein said support includes means for allowing a free movement of said other end of said spring through a limited path, whereby said spring remains unstressed during an initial displacement of said sliver trumpet from said first position toward said second position.

14. A sliver coiler as defined in claim 12, wherein said spring is a tension spring formed of a plurality of serially connected spring elements having unlike spring characteristics.

15. A sliver coiler as defined in claim 3, wherein said clamping means comprises a drive including a parallelogram linkage having a first pair of opposite articulations and a second pair of opposite articulations; said clamping means further comprising first and second cooperating clamping elements disposed downstream of said sliver exit and being jointed to the articulations of said first pair; one articulation of said second pair being stationarily supported and the other articulation of said second pair being jointed to said sliver trumpet.

16. A sliver coiler as defined in claim 3, wherein said clamping means comprises a clamping element carried by said sliver trumpet and cooperating with a wall face defining said passage of said sliver trumpet; and a drive connected to said clamping element for moving said clamping element into said clamping and open positions.

17. A sliver coiler as defined in claim 3, wherein said clamping means is carried by said sliver trumpet to move therewith as a unit between said first and second positions.

18. A sliver coiler as defined in claim 3, wherein said clamping means are stationarily supported upstream of said roller pair.

19. A sliver coiler as defined in claim 3, in combination with a coiler can transport means for positioning an empty coiler can into an operative alignment with said coiler head for receiving the sliver therefrom and for removing a filled coiler can from the coiler head; comprising a sensor means for determining the extent of fill of a coiler can while receiving sliver from said coiler head; a first drive means for rotating one of the coiler head and the roller pair; a second drive means for driving said coiler can transport means; a third drive means for moving said sliver trumpet between said first and second positions; a fourth drive means for driving said clamping means; and a control means connected to said sensor means, said first, second, third and fourth drive means for coordinating the operation of said first, second, third and fourth drive means as a function of signals emitted by said sensor means.

20. A sliver coiler as defined in claim 19, wherein said third and fourth drive means form a common drive means for said sliver trumpet and said clamping means.

* * * * *